US005108194A

United States Patent [19]

Raden

[11] Patent Number: 5,108,194

[45] Date of Patent: Apr. 28, 1992

[54] SECURITY BAG

[76] Inventor: David T. Raden, 2701 W. 121st Ter., Leawood, Kans. 66209

[21] Appl. No.: 638,331

[22] Filed: Jan. 7, 1991

[51] Int. Cl.[5] ..... B65D 27/30; B65D 27/38

[52] U.S. Cl. ..... 383/5; 383/66; 383/903

[58] Field of Search ..... 383/5, 66, 903

[56] References Cited

U.S. PATENT DOCUMENTS

| | | | |
|---|---|---|---|
| 3,933,304 | 1/1976 | Judd . | |
| 3,942,713 | 3/1976 | Olson et al. | 383/66 |
| 4,417,658 | 11/1983 | Gardner et al. | 383/66 |
| 4,464,158 | 8/1984 | Kardon . | |
| 4,483,018 | 11/1984 | Whelan . | |
| 4,509,196 | 4/1985 | Sak et al. . | |
| 4,510,621 | 4/1985 | Sak et al. . | |
| 4,550,831 | 11/1985 | Whitford | 383/66 |
| 4,653,113 | 3/1987 | Taylor . | |
| 4,709,397 | 11/1987 | Voshall et al. . | |
| 4,709,399 | 11/1987 | Sanders | 383/5 |
| 4,712,729 | 12/1987 | Craig . | |
| 4,720,040 | 1/1988 | Gurewitz . | |
| 4,733,817 | 3/1988 | Makowka . | |
| 4,786,190 | 11/1988 | Van Erden et al. | 383/66 |
| 4,988,547 | 1/1991 | Voto, Jr. et al. | 383/5 |

FOREIGN PATENT DOCUMENTS

| | | | |
|---|---|---|---|
| 549840 | 12/1957 | Canada | 383/66 |
| 2167381 | 5/1986 | United Kingdom | 383/5 |

*Primary Examiner*—Gary E. Elkins
*Attorney, Agent, or Firm*—Michael Yakimo, Jr.

[57] ABSTRACT

A closure system for a plactic security bag comprises an access opening with an adhesive laden cellophane carrier film regulating access thereto. The film is affixed to the bag below the lower edge of the access opening and has a band of "hot melt" therealong. Upon removal of the releasable liner the carrier film is positioned such that the "hot melt" spans the access opening and closes the same. Lacquer coating at the ends of the opening preclude undesirable sticking of the releasable liner to the security bag. The ends of the access opening are "heat sealed" and cooperate with the adhesive to preclude leakage of liquid through the closed opening. Entry of the bag is accomplished by tearing the carrier film and/or bag proper which is evident to an observer.

10 Claims, 1 Drawing Sheet

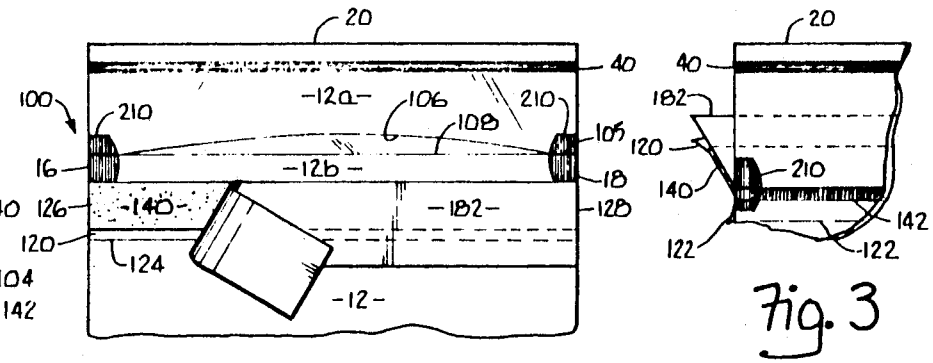
Fig. 3
Fig. 2
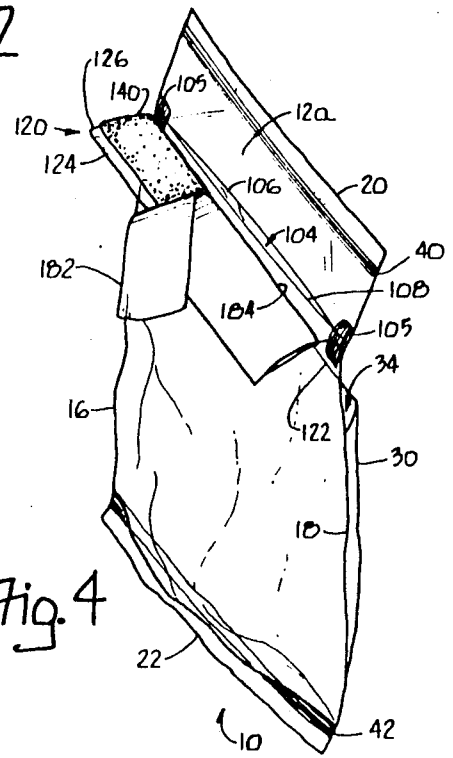
Fig. 4
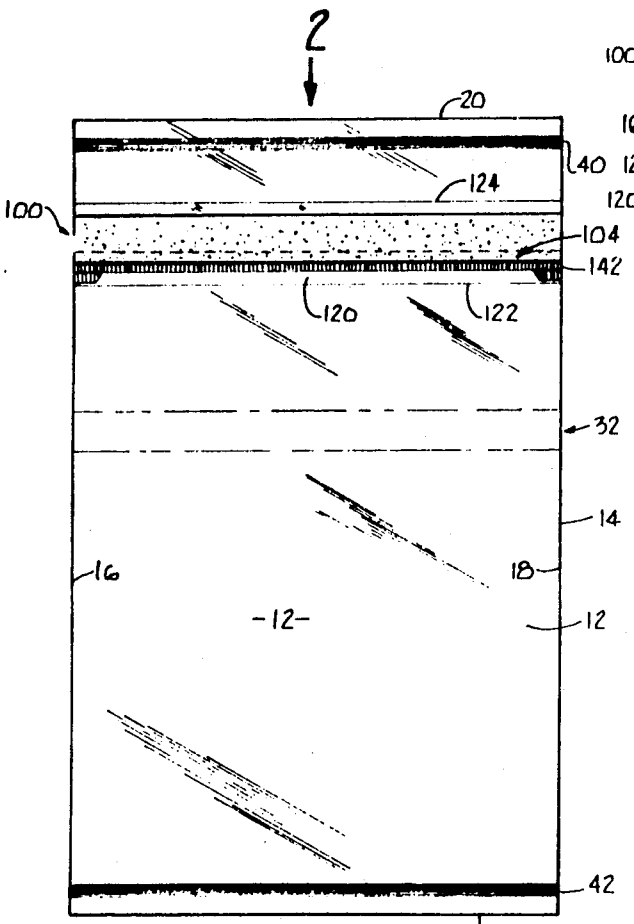
Fig. 1

SECURITY BAG

BACKGROUND OF THE INVENTION

This invention generally relates to containers, and more particularly, to an improved self-sealing security bag having a closure system resistant to undesirable opening and indicative of tampering therewith.

Known security bags are expensive to manufacture and have various degrees of resistance to tampering. One type of bag, as shown in U.S. Pat. No. 4,483,019, comprises a plastic bag closed at one end with a foldable flap. Adhesive materials on the bag and flap are brought into a mating relationship upon folding the flap so as to close the access opening to the bag proper. Such a bag appears to be relatively expensive to manufacture.

Another type of security bag is shown in U.S. Pat. No. 4,510,621 which illustrates a security pouch with an access opening flanked by pressure-sensitive adhesive. Upon folding the pouch onto itself the access opening is sealed which precludes ready access thereto.

U.S. Pat. No. 4,464,158 discloses a method of making a tamper proof bag closure which applies a band of micro-capsules along the access opening. Upon folding the flap along a fold line ready entry to the access opening is precluded.

Although assumably effective in operation, such bags are relatively expensive to manufacture and require operator attention during use in order to effect a reliable closure. Moreover, the foldable operation of such bags require increased operator attention for proper closure and may separate the edges of the slot which form the access opening. Although such a separation may not be critical for the transport of solid items, transported liquids, such as urine and/or blood specimens, may seep through this separation if their container is broken during transport.

In response thereto I have invented a tamper evident, leak proof security bag which presents a positive seal along the access opening without the need to fold the mating surfaces of the bag in a facing relationship and without the need for critical user attention. My security bag generally comprises a container/bag made of a plastic material having an elongated access opening in the front panel which presents upper and lower edges. A carrier film is affixed below the lower edge of the access opening and has an adhesive material thereon. A releasable liner extends along the adhesive to preclude undesirable, premature adhesion. Upon use the releasable liner is removed from the adhesive material. The free edge of the carrier film is then brought into contact with the front panel of the bag. This action brings the upper and lower edges of the access opening into a contiguous or otherwise closing relationship with the adhesive material transversing the closure so as to preclude undesirable opening. Lacquer at the ends of the access opening precludes premature adhesion of the releasable liner to the bag proper prior to a desired closure.

Accordingly, it is a general object of this invention to provide a novel closure system for a security bag or the like.

Another object of this invention is to provide a closure system, as aforesaid, which precludes separation of the access opening during use.

Still a further object of this invention is to provide a closure system, as aforesaid, which is waterproof, tamper evident, temperature resistant and precludes seepage of liquids therefrom.

Another object of this invention is to provide a closure system, as aforesaid, which presents means for sealing the access opening of the closure system by means of an adhesive laden carrier film.

A particular object of this invention is to provide a closure system, as aforesaid, which positively seals the edges of the access opening to preclude liquid seepage therefrom.

Still another object of this invention is to provide a closure system, as aforesaid, which precludes a premature, undesirable sealing of the access opening.

Other objects and advantages of this invention will become apparent from the following description taken in connection with the accompanying drawings, wherein is set forth by way of illustration and example, a now preferred embodiment of this invention.

BRIEF DESCRIPTION OF THE DRAWINGS

FIG. 1 is a pan elevation view of the closure system utilized in a security bag with the access opening of the closure system being in a sealed, closed position;

FIG. 2 is a fragmentary view of the top of the bag in FIG. 1, on an enlarged scale, with the adhesive-laden carrier film being folded over and a portion of the liner removed to illustrate the lower edge of the access opening, the adhesive band on the carrier film and the top edge of the carrier film;

FIG. 3 is a fragmentary view of one edge of the closure system from the rear thereof to show the relationship among the bag, releasable liner, carrier film, lacquer and end seals;

FIG. 4 is a perspective view of the access opening of the security bag in an open position with a portion of the releasable liner being removed from the carrier film.

DESCRIPTION OF THE PREFERRED EMBODIMENT

Turning more particularly to the drawings, FIGS. 1–4 illustrate the closure system 100 incorporated into a plastic bag 10. The bag 10 may be constructed of any desired material but is now preferably made of an opaque or transparent, plastic material.

The bag 10 includes generally rectangular, front 12 and rear panels 14 sealed together along their marginal edges to form sealed longitudinal, side edges 16, 18 and sealed lateral upper 20 and lower 22 edges. Lateral reinforcing seals are illustrated along the upper and lower lateral extents of the bag at 40, 42. A third or back panel 30 may likewise be sealed to the rear panel 14 along the edges with a lateral slot 32 being placed therein to present a pouch 34 for insertion of accompanying documents or the like.

The closure system 100 includes a slot 104 sliced in the front panel 12 which laterally extends between the longitudinal edges 16, 18. Sot 104 thus presents an access opening 104 upon separation of the upper 106 and lower defining edges 108. The lateral ends of slot 104 are "heat sealed" shut to prevent undesirable separation of the lateral ends of the upper 106 and lower edges 108 and leakage therethrough. Accordingly, positioning such edges 106, 108 in a contiguous relationship closes the slot/access opening 104.

Below the lower edge 108 is affixed a generally rectangular strip 120 of carrier film made of various materials e.g. polyethylene, polypropylene, cellophane etc. The carrier film 120 comprises lower 122 and upper 124 laterally extending edges bounded by vertical edges 126. 128. Lower edge 122 is contiguous to panel 12 and laterally extends below the bottom edge 108 of access opening 104.

An adhesive material 140 is placed along the carrier film strip 120. Such material is commonly referred to as "hot melt" Such "hot melt" 140 is applied along the entire length of the carrier film 120 and a substantial width thereof. A strip 142 of this "hot melt" affixes a lateral portion of the carrier film 120 below the lower edge 108 of access opening 104 such that the lower edge 122 of the carrier film extends below the bottom edge 108 of the access opening 104. This strip 142 presents a line about which the carrier film 120 may be rotated or otherwise moved between its FIG. 2 and FIG. 1 position. The remaining "hot melt" above strip 142 is of a width so as to extend substantially towards the Lop edge 124 of the carrier film 120.

A releasable liner 182 is placed along the remaining extent of the exposed "hot melt" 140 of the carrier film 120 to preclude premature adhesion of the carrier film 120 with the front panel 12. This liner 182 keeps the exposed "hot melt" 140 away from the plastic surfaces. The carrier film 120 and liner 182 are rotatable about strip 142 to a FIG. 2 or FIG. 4 position for subsequent liner removal. A portion of this liner 182 is shown as partially removed in these figures to show the top edge 124 and adhesive 140 of the underlying carrier film 120.

Also located at the marginal edges of the access opening 104 atop the heat seals 105 is a lacquer coating 210. Such coating 210 preclude undesirable sticking of the liner 182 with the edges 16, 18 of panel 12 which would delimit ready access to the access opening 104 and removal of liner 182 as shown in FIGS. 2, 4.

Upon use the stored item is placed in the bag via access opening 104. Subsequently the releasable liner 182 of film 120 as positioned adjacent strip 142 is stripped from the carrier film 120 so as to expose the "hot melt" adhesive material 140. The upper edge 124 of carrier film 120 is then upwardly moved about strip 142 to its FIG. 1 position and into contact with the portion 12*a* of front panel 12 above upper edge 106. This action brings the top and bottom edges 106, 108 of access opening 104 into a relationship for closure of the access opening 104. The exposed hot melt 140 is thus brought into contact with the portion 12*b* of panel 12 positioned below lower edge 108 and panel portion 12*a* above upper edge 106 so as to maintain the edges 106, 108 of access opening 104 in their closure relationship. Thus, the adhesive laden carrier film 120 extends along the length of such opening 104 so as to preclude access to the opening 104. Moreover, the marginal ends of the opening 104 are likewise covered with the adhesive 140 which in a combination with the above described marginal "heat seals" 105 further precludes any leakage through the opening 104 of any liquids or the like.

Subsequent access to opening 104 is achieved only by ripping the carrier film 120 and/or panels 12, 14 which is then evident to an observer.

It is to be understood that while a certain form of this invention has been illustrated and described, it is not limited thereto, except in so far as such limitations are included in the following claims and allowable functional equivalents thereof.

Having thus described the invention, what is claimed as new and desired to be secured by Letters Patent is:

1. A closure system for a security bag formed by first and second panels joined together at their respective marginal edges comprising:

a slot extending between a pair of the opposed marginal edges of the first panel of said bag. said slot presenting an access opening with first and second opposed edges;

a carrier film extending between the opposed marginal edges and along the length of said slot, said carrier film having a portion extending along said slot and attached to the first panel at a position generally below said first edge of said slot;

said carrier film having a free edge extending along the length of said slot, said free edge displaced from said attached carrier film portion;

a band of adhesive material positioned along the extent of said carrier film;

a lacquer material along a portion of said first panel;

a releasable liner extending along said adhesive material to preclude an undesired adhesion of said carrier film to said first panel;

said lacquer material precluding a sticking of said releasable liner and associated carrier film to said first panel whereupon removal of said liner and placement of said free edge of said carrier film against said first panel and beyond said second edge of said opening positions said first and second opposed edges of said opening into a relationship to close said opening with said adhesive material spanning said first and second edges of said opening to seal the same, whereby subsequent access to said opening is evident by distortion of said carrier film and/or said panels.

2. The device as claimed in claim 1 wherein said attached portion of said carrier film provides an axis for movement of said attached carrier film between a position displaced from said first panel and to said position against said first panel.

3. The device as claimed in claim 1 wherein said lacquer material is positioned at the portions of said slot adjacent said pair of opposed marginal edges.

4. The device as claimed in claim 1 wherein said attachment said carrier film at said position generally below said first edge of said slot presents a fold line for said carrier film.

5. The device as claimed in claim 4 wherein an edge of said band of adhesive extends along said fold line and towards said free edge of said carrier film.

6. The device as claimed in claim 5 wherein an edge of said releasable liner extends between said fold line and said free edge in congruency with said adhesive material.

7. The device as claimed in claim 1 further comprising:

a pair of heat seals at said first and second opposed edges of said slot, said heat seas cooperating with said adhesive to preclude leakage of liquid through said closed opening.

8. A closure system for a security bag formed by first and second panels joined together at their respective marginal edges comprising:

a slot extending between the opposed marginal edges of the first panel of said bag, said slot presenting an access opening with first and second opposed edges;

a carrier film extending between the opposed marginal edges and along the length of said slot, said carrier film having a first edge extending along said slot and attached to said first panel at a position generally displaced from one of said edges of said slot;

said carrier film having a free edge extending along the length of said slot, said free edge displaced from said attached first carrier film edge;

a band of adhesive material positioned along the extent of said carrier film;

a releasable liner extending along said adhesive material to preclude an undesired adhesion of said carrier film to said first panel;

a lacquer material along a portion of said first panel, said lacquer material precluding a sticking of said releasable liner to said first panel whereupon removal of said liner and placement of said free edge of said carrier film against said panel and beyond the other of said edges of said opening positions said opposed edges of said opening into a relationship to close said opening with said adhesive material spanning said first and second edges of said opening to seal the same, whereby subsequent access to said opening is evident by distortion of said carrier film and/or said panels.

9. The device as claimed in claim 8 wherein said lacquer material is positioned at first and second opposed portions of said slot adjacent said pair of opposed marginal edges.

10. A closure system for a security bag formed by first and second panels joined together at their respective marginal edges comprising:

a slot extending between the opposed marginal edges of the first panel of said bag, said slot presenting an access opening with first and second opposed edges;

a carrier film extending between the opposed marginal edges and along the length of said slot, said carrier film having a first edge extending along said slot and attached to said first panel at a position generally displaced from one of said edges of said slot;

said carrier film having a free edge extending along the length of said slot, said free edge displaced from said attached first carrier film edge;

a band of adhesive material positioned along the extent of said carrier film;

a releasable liner extending along said adhesive material to preclude an undesired adhesion of said carrier film to said first panel;

means positioned along a portion of said first panel precluding a sticking of said releasable liner to said first panel whereupon removal of said liner and placement of said free edge of said carrier film against said panel and beyond the other of said edges of said opening positions said opposed edges of said opening into a relationship to close said opening with said adhesive material spanning said first and second edges of said opening to seal the same, whereby subsequent access to said opening is evident by distortion of said carrier film and/or said panels.

* * * * *

UNITED STATES PATENT AND TRADEMARK OFFICE

CERTIFICATE OF CORRECTION

PATENT NO. : 5,108,194

DATED : April 28, 1992

INVENTOR(S) : David T. Raden

It is certified that error appears in the above—identified patent and that said Letters Patent is hereby corrected as shown below:

Column 2, line 21, delete "pan" and substitute --plan--.

Column 2, line 57, delete "Sot" and substitute --Slot--.

Column 3, line 7, after the first occurrence of "hot melt" insert a period.

Column 3, line 17, delete "Lop" and substitute --top--.

Column 4, line 56, delete "seas" and substitute --seals--.

Signed and Sealed this

Twenty-second Day of June, 1993

*Attest:*

Michael K. Kirk

MICHAEL K. KIRK

*Attesting Officer*

*Acting Commissioner of Patents and Trademarks*